US005666886A

United States Patent [19]

Alexander et al.

[11] Patent Number: 5,666,886

[45] Date of Patent: Sep. 16, 1997

[54] PALLETT ASSEMBLY

[75] Inventors: Samuel Ray Alexander; Sarah Rheagan Alexander; Gaylord Allen Hiler, all of Diamondhead, Miss.

[73] Assignee: E. I. Du Pont de Nemours and Company, Wilmington, Del.

[21] Appl. No.: 490,924

[22] Filed: Jun. 16, 1995

Related U.S. Application Data

[63] Continuation-in-part of Ser. No. 276,577, Jul. 18, 1994, Pat. No. 5,492,069.

[51] Int. Cl.[6] ..... B65D 19/00

[52] U.S. Cl. ..... 108/56.3; 108/901

[58] Field of Search ..... 108/56.3, 51.1, 108/901, 56.1, 52.1, 53.3

[56] References Cited

U.S. PATENT DOCUMENTS

| | | | |
|---|---|---|---|
| 2,463,214 | 3/1949 | Stoner . | |
| 3,342,146 | 9/1967 | Lessholm . | |
| 3,691,964 | 9/1972 | Lrson et al. . | |
| 3,826,205 | 7/1974 | Weiss . | |
| 3,857,342 | 12/1974 | Johns . | |
| 3,915,099 | 10/1975 | Wies et al. | 108/56.3 |
| 4,060,037 | 11/1977 | Gustafsson . | |
| 4,384,531 | 5/1983 | Spurgcon . | |
| 4,735,154 | 4/1988 | Hemery . | |
| 4,843,976 | 7/1989 | Pigott et al. . | |
| 5,007,352 | 4/1991 | Calkoch . | |
| 5,046,434 | 9/1991 | Breezer et al. . | |
| 5,057,350 | 10/1991 | Gezels . | |
| 5,094,175 | 3/1992 | Christie . | |
| 5,097,951 | 3/1992 | Pigott et al. . | |
| 5,123,359 | 6/1992 | DelBalso . | |
| 5,160,029 | 11/1992 | Pigot et al. . | |
| 5,170,722 | 12/1992 | Freisner et al. . | |
| 5,193,464 | 3/1993 | Morden | 108/901 X |
| 5,197,396 | 3/1993 | Breezer et al. . | |
| 5,351,628 | 10/1994 | Breezer et al. . | |
| 5,367,961 | 11/1994 | Arai et al. | 108/56.3 |

FOREIGN PATENT DOCUMENTS

| | | | |
|---|---|---|---|
| 2101346 | 3/1972 | France | 108/56.3 |
| 2157998 | 1/1973 | Germany | 108/56.1 |
| 2303124 | 7/1974 | Germany . | |
| 3521830 | 1/1987 | Germany | 108/56.3 |
| 4306879 | 9/1994 | Germany | 108/51.1 |
| 2214485 | 9/1989 | United Kingdom . | |
| 9113810 | 9/1991 | WIPO . | |
| 9422728 | 10/1994 | WIPO . | |

*Primary Examiner*—Jose V. Chen
*Assistant Examiner*—Janet M. Wilkens

[57] ABSTRACT

A modular double deck shipping pallet assembly which may be disassembled to smaller volume for shipping, reassembly and reuse. All of the components of the assembly are injection molded from recyclable or recycled thermoplastic polymers.

25 Claims, 4 Drawing Sheets

PALLETT ASSEMBLY

CROSS-REFERENCE TO RELATED APPLICATION

This application is a continuation-in-part of U.S. patent application Ser. No. 08/276,527, filed Jul. 18, 1994, now U.S. Pat. No. 5,492,069, issued Feb. 20, 1996.

FIELD OF THE INVENTION

The invention is directed to a double deck shipping pallet assembly which may be disassembled to smaller volume for shipping, reassembly and reuse and which is made entirely from recyclable or recycled polymers.

BACKGROUND OF THE INVENTION

Wooden pallets have for many years been the primary method for unitizing freight for mechanical handling during shipment and storage. While they are effective for this purpose and reasonable in cost, they nevertheless present significant problems with respect to compliance with many shipping and environmental regulations. For example OSHA regulations state that a person should not lift over 50 pounds, but most wooden pallets weigh on the order of 65–80 pounds. Moreover, when they are stored outdoors they tend to pick up even more weight by adsorption of water. In addition, many countries require that wooden pallets be fumigated before entry.

In addition, wooden pallets create a space problem when shipping and storage space are critical because they cannot usually be disassembled for reuse and their typical thickness of six to nine inches causes a substantial reduction in useful capacity.

Wooden pallets also present a substantial safety and sanitation problem. A major safety problem is flammability of the wood from which they are made. Thus, wooden pallets in storage can create an intense fire if they are ignited which, in some circumstances, may be sufficient to overwhelm conventional sprinkler systems. Also, wooden pallets often have sharp edges, splinters and protruding nails which tend to damage product and frequently cause injury to personnel handling the pallets.

Wooden pallets too often become a health problem because they become infested with insects, birds and rodents. Moreover, because they can't be cleaned effectively with steam, they are subject to mildew and mold contamination. In addition, wooden pallets degrade rapidly in normal atmospheric exposure. Therefore, they can be reused only limitedly.

Structurally, wooden pallets suffer from other disadvantages. For example, conventional wooden pallet construction does not allow fourway entry. They also have sharp edges and nails which are likely to damage product packaging, thus, requiring the use of cardboard covers (slip sheets). As mentioned above, a serious disadvantage is that they cannot be disassembled for volume reduction when they are shipped for reuse.

While it has been proposed that some of the disadvantages of wood pallet construction might be eliminated by the use of plastics, such attempts have been less economical than wood. For example, to make a monolithic roomed pallet would involve a very high cost for making the mold. Furthermore, a one-piece pallet of this type could not be disassembled for reuse.

Recent efforts in this regard are illustrated by the following listed prior art patents, which are summarized below:

SUMMARY OF THE PRIOR ART

U.S. Pat. No. 4,843,976 to Pigott et al. is directed to a plastic pallet comprising a pair of identical frames having a plurality of spaced openings, the frame members being interconnected with circular hollow core connectors. Each connector includes a central core and a surrounding sleeve interconnected by spokes. The core has flexible tangs that extend beyond opposite ends of the sleeve and fit into and releasably interconnect through the openings in the frame members.

U.S. Pat. No. 5,046,434 to Breezer et al. is directed to a plastic reinforced unitary plastic pallet comprising a planar upper load-bearing sheet and a parallel lower sheet in which feet are formed by a plurality of concave depressions in the two sheets. The thusly formed sheets are reinforced with plastic fused to the feet between the upper and lower sheets. The load-bearing sheet has a peripheral lip. The pallet is formed from thermoplastic, which is indicated to be recyclable, high density polyethylene being preferred. The pallet is formed by a thermoforming process in which the two plastic sheets are vacuum molded.

U.S. Pat. No. 5,057,350 to Gezels is directed to a pallet formed from at least two types of polymeric material. In particular, the pallet is formed from a dense polymeric outer layer filled with a foamed inner layer which has been injected after the outer layer is formed. No particular polymers are named though claims are directed to a pallet in which the outer layer is a copolymer and the inner layer is a homopolymer.

U.S. Pat. No. 5,094,175 to Christie is directed to a modular pallet formed from a pair of upper and lower pallet sections, each of which includes a plurality of separate units which can be formed by molding recycled or recyclable plastics. The upper pallet section has four similar rectangular sections which include a flat grid-like base element and a plurality of downwardly facing cup-like connectors. The lower pallet section is comprised of a pair of rectangular major units having a plurality of upwardly facing cup-like connectors which interlock by telescopic engagement with the downwardly facing connectors on the upper layer. After assembly, the interlocked parts are deformed to prevent accidental separation.

U.S. Pat. No. 5,123,359 to DelBalso is directed to a heavy duty pallet comprising a rigid internal reinforcing skeleton, a rigid non-shrinkable plastic sheet tightly covering the lower surface, open spaces, sides and ends of the skeleton, and a second plastic sheet covering the upper surface of the skeleton to form a flat load deck. The skeleton is made of wood or aluminum. A non-skid surface is indicated for the surface of the load deck.

U.S. Pat. No. 5,170,722 to Friesner et al. is directed to a pallet assembly consisting of two sets of interlocking runners. A first runner has an opening to receive a plurality of second runners and a second runner has slots which mate with the upper and lower members of the first runner to secure the second runners in position. Positioning of the second runners is accomplished by bosses on the slot surface of the first runner. The runners are indicated to be made of wood, metal or plastics, but in all cases must be flexible and elastic to achieve good fit between the slot and the surfaces of the second runner. Preferred materials of construction are thermoset and thermoplastic polymers. The use of recycled thermoplastic polymers is disclosed.

U.S. Pat. No. 5,197,396 to Breezer et al. is directed to a double deck plastic pallet comprising an upper deck formed from two sheets of thermoplastic fused together and reinforced with a metal sheet between the two sheets. The upper deck assembly is connected to a similar lower deck assembly by means of plurality of plastic polygonal posts extending there between. The decks are fastened together by bolts through the posts.

SUMMARY OF THE INVENTION

The invention is therefore directed to a double deck shipping pallet assembly, which may be disassembled to smaller volume for shipping, reassembly and reuse, comprising a (1) a rigid substantially planar rectangular upper deck having an upper load surface and lower support surface, (2) a plurality of detachable hollow cupped feet having a symmetrical cross section, the open ends of which feet depend from and are attached to the upper deck through openings in the deck assembly by means of rotating-type connections and the cupped feet are arranged in a centrally positioned symmetrical array of lines and columns, each line and column being comprised of at least three such feet in both the longitudinal and transverse directions of the array, the cupped end of each of the feet being linked both longitudinally and transversely by (3) a rigid substantially planar rectangular lower deck having an upper surface and a lower surface and a plurality of openings through which the cupped feet are connected to the lower deck at or near the cupped end of each of the feet, the open ends of the cupped feet being attached to the upper deck by means of rotating-type connections and the cupped end of the feet being attached to the lower deck by means of rotatable snap-fit connections of the cupped feet, the complementary components of which connections are molded into the periphery of the feet and the inside surface of the foot attachment openings in the upper and lower decks, the decks and cupped foot members are being formed by injection molding of a molten normally solid thermoplastic polymer.

In a preferred aspect, the invention is directed to the above-described pallet assembly in which both the upper and lower decks are formed from rectangular interlocking sections having a substantially identical configuration.

BRIEF DESCRIPTION OF THE DRAWING

The Drawing consists of eight figures as follows.

DETAILED DESCRIPTION OF THE INVENTION

The pallet assembly of the invention is directed toward solution of a number of problems commonly associated with conventional wooden pallets and prior art pallets made from various plastics:

(1) The pallet assembly can be disassembled and reassembled without special tools. A hammer and screwdriver are usually sufficient.

(2) The pallet assembly is comprised of a minimal number of separate parts. In the case of a typical 45×45 inch pallet, only eleven separate parts are needed when both decks are molded as one piece.

(3) The pallet assembly is comprised of a minimal number of different parts. In the case of a typical 45×45 inch pallet, only three different parts are required. Thus, both molding costs and parts inventory costs are minimized.

(4) All of the component parts of the assembly, including the deck sections, can be relatively small in size by which both the capital cost and operating costs of the injection molding equipment are reduced.

(5) All of the component parts are easily formed by injection molding techniques. Therefore, only a single technology is involved in manufacturing the component parts of the pallet assembly.

(6) The component parts are designed to take up minimal space when the pallets are disassembled and the parts shipped.

(7) All of the parts can be made of a single recyclable polymer or polymer mixture. It is not necessary to use different polymers on different parts. Moreover, there are no metal parts. On the other hand, if desired, different pans of the pallet can be made from different polymers.

(8) The pallets can be fabricated from a wide variety of recyclable and/or recycled polymers which are available at low cost from a large number of sources.

(9) The pallet assembly is capable of being adapted to a wide range of pallet geometries, sizes and strength requirements.

(10) Though the pallet may initially cost more than conventional wooden pallets, it nevertheless becomes more economical in use because of its longer useful life, light weight, convenient disassembly for back shipment and very low maintenance requirements; and

(11) The pallet of the invention can be 20–50 pounds lighter than comparably sized wooden pallets.

Figure 1:
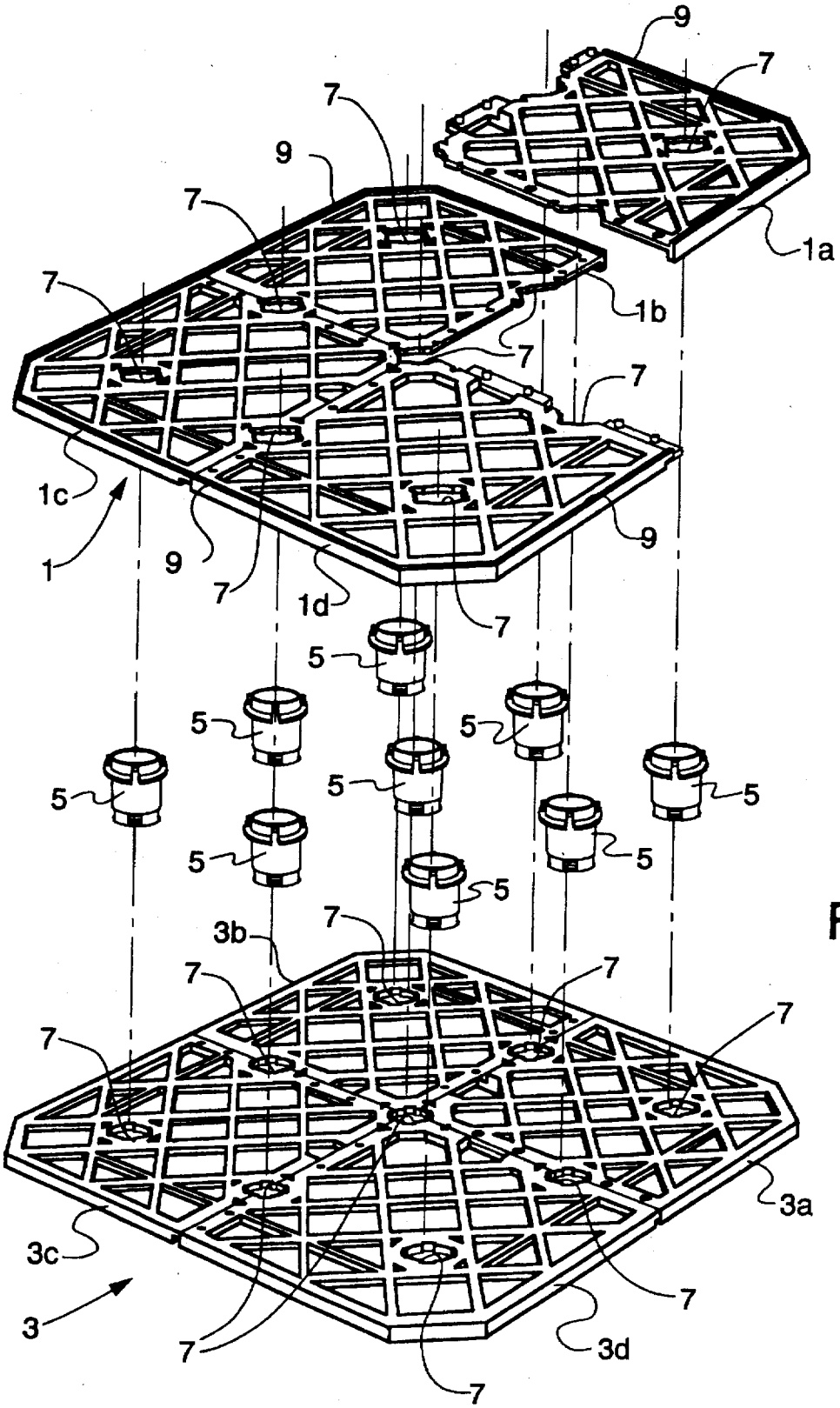
FIG. 1 is an exploded view of the pallet assembly in which both decks are modular.

Turning now to FIG. 1 of the Drawing, which is an exploded view of the pallet assembly of the invention, the pallet is comprised of upper load deck 1 and lower load deck 3, which are connected by a plurality of cupped feet 5. In the best mode of the invention, the upper deck 1 is made up from four substantially identical modules 1*a–d*. The lower deck is fabricated from four substantially identical modules 3*a–d*. The modules are interlocked by means of lap joints 4 along two edges of the module. Each lap joint 4 on both the upper and lower decks is further interlocked by means of a plurality of bosses 6 and matching recesses spaced along the matched surfaces of the lap joints 4. In a preferred aspect, the modules are fused together at one or more sites along the lap joints for greater strength. The upper deck 1 contains an array of nine circular openings 7, the circumferences of which have acceptor means by which the cupped feet 5 are attached by means of complementary insertion means. The cupped feet 5 are interlocked with the underside of the upper deck 1 through the circular openings 7, which are here arranged in an array of three lines and three transverse columns. As shown in FIG. 1, the modular upper deck sections 1*a–d* are of generally square configuration in order that only a single section shape need be used. However, other generally rectangular shapes can be used to accommodate other pallet sizes and foot arrays. It will be recognized, however, that when more complex arrays are used for attachment of the cupped feet 5, more than one modular section will be required. For example, when a symmetrical array of sixteen feet is used, three different deck module configurations would be needed. Alternatively, the upper deck 1 can be molded as a single piece.

As shown in FIG. 1, the upper deck has an upward extending lip 9 to limit lateral motion of the load.

The cupped feet 5 extending from the top deck 1 are affixed to the lower deck 3 through a series of nine circular openings 7 in the lower deck by means of a snap-fit connection which are rotatable both after attachment of the cupped feet 5 to the lower deck 3 and before attachment to the upper deck 1. The rotatability of the cupped feet before attachment to the upper deck is essential for the feet to be attached to the rotating connections to the upper deck. Likewise, rotatability of the cupped feet after attachment to the lower deck is essential for the pallet to be disassembled since the bayonet or screw connections to the upper deck must be rotated for removal.

Because the cupped feet are attached to the upper deck by means of rotating connections (such as screw connections or bayonet connections), it is essential that the attached cupped feet be rotatable in the same direction without disengagement of the cupped feet from the lower deck. That is, the cupped feet must be attached to the upper deck by means of rotating connections and the cupped feet must be attached to the lower deck in such manner that they are rotable during rotative disengagement of the upper deck connections. By this means, the cupped feet can be removed first from either the upper or lower deck.

To assemble the pallet, the cupped feet are first inserted in the top deck and then into the bottom deck. To disassemble the pallet, the cupped feet are first removed from the upper deck and then from the bottom deck.

Figure 2:
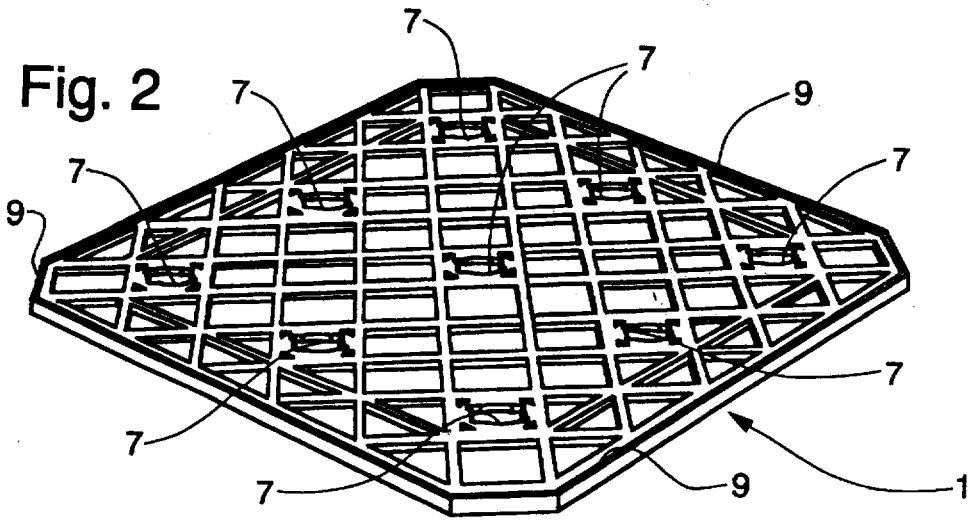
FIG. 2 is an orthographic view of the upper deck which is fabricated in one piece.
Figure 3:
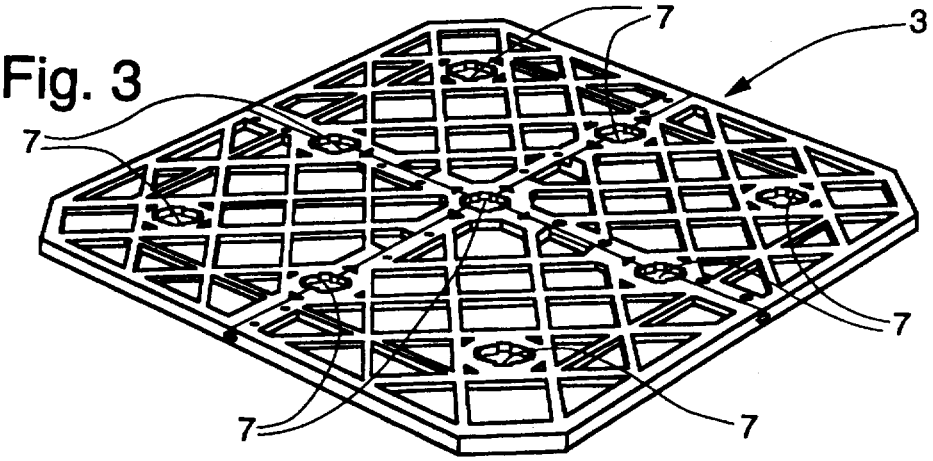
FIG. 3 is an orthographic view of the lower deck which is fabricated by assembly of four modular sections.
Figure 4:
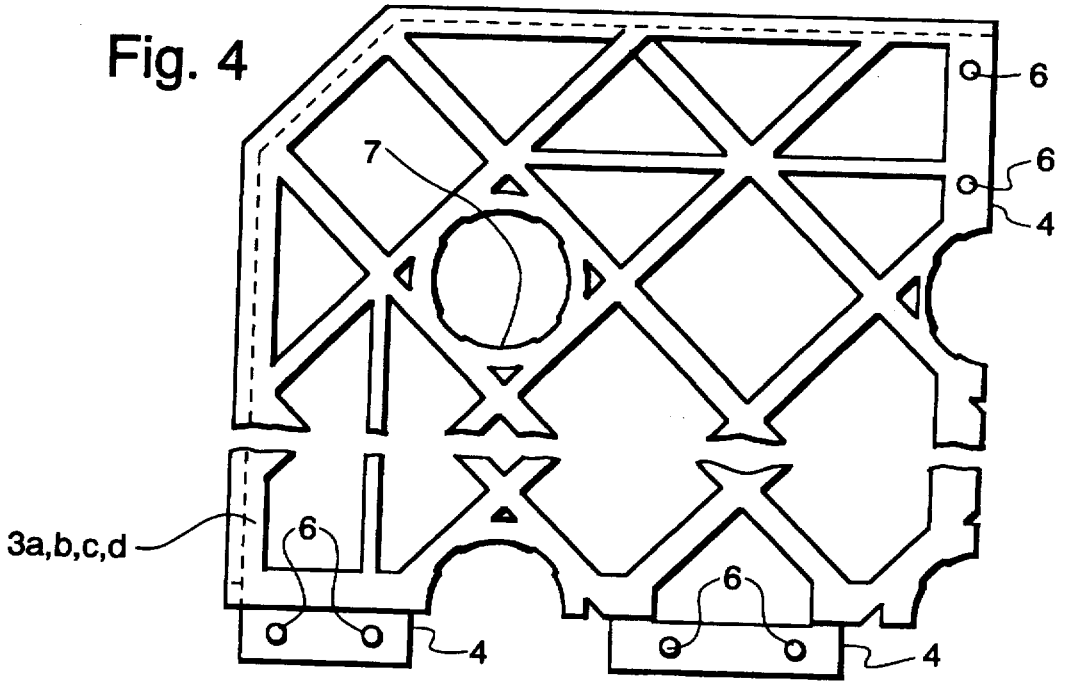
FIG. 4 is a plan view of a lower deck module portion showing the configuration of the receiving hole for the cupped feet.

FIGS. 2 and 3 show a typical configuration for the upper deck 1 and the lower deck 3 respectively. In FIG. 2, the upper deck is shown as being unitary; while in FIG. 3, the lower deck is shown as consisting of four modules. However, either deck can be modular or it can be molded in four separate sections. FIG. 4 shows a typical module configuration for the lower decks as shown in FIG. 3 when the lower deck consists of four deck modules of the same configuration. The precise arrangement of openings to make the pallet lighter in weight can, of course, be widely varied in accordance with the particular strength requirements of the pallet. As in FIG. 2, the upper deck has an upturned lip 9 on the outer edges to restrict lateral movement of the load. The lower deck can have the same configuration, but without the lip.

A unique feature of this best mode of the invention is that, by locating most of the foot attachment openings across the joints between two or more of the upper deck modular sections, the attachment of the cupped feet 5 to the upper deck 1 also serves to interlock the modular deck sections 1 *a–d*. In a typical square array of nine cupped feet, all but the four corner feet are preferably attached to foot attachment openings 7 formed from two or more adjoining modular deck sections. In the preferred embodiment illustrated in FIG. 1, it can be seen that four of the attachment openings extend between two sections and the one in the center of the array extends between all four of the modular sections.

Figure 5:
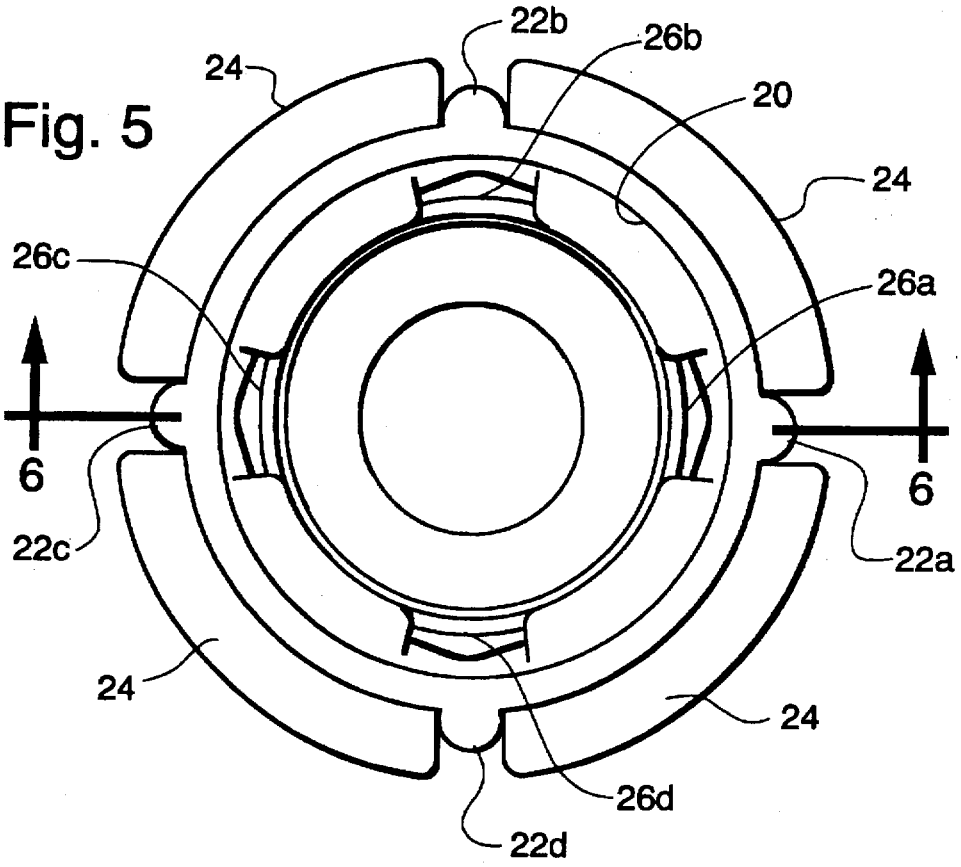
FIG. 5 is a top view of one of the cupped feet.
Figure 6:
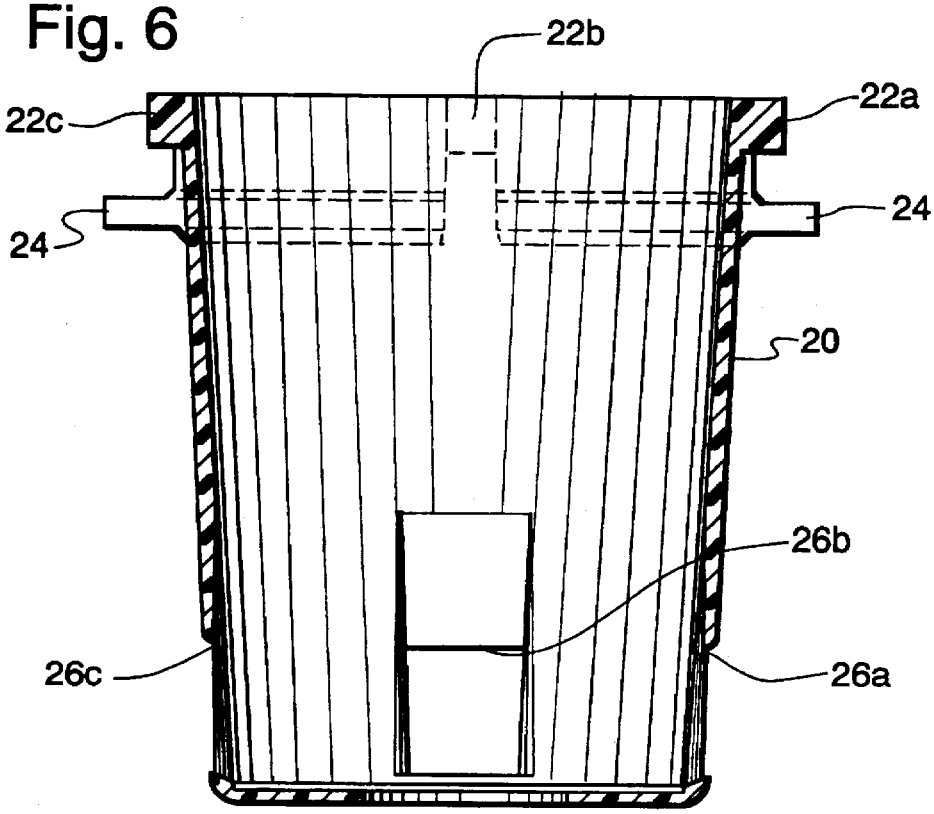
FIG. 6 is a sectional view of the cupped foot of FIG. 5 taken along section 6—6 of FIG. 5.

Preferably, the cupped feet 5 are circular in cross section, open at the top, but cupped at the bottom in order to get broader weight distribution. In a preferred embodiment, the outside perimeter of the upper end of the cupped foot 5 is molded in the form of a bayonet-type connection which inserts in a corresponding acceptor recess molded on the perimeter of the circular openings 7. Though the above-described arrangement is preferred, the interlocking device can also be reversed. That is, the circumference of the circular opening 7 can be extended in the form of a lip, the outside of which is molded in the form of a bayonet-type connection and the inside of the cupped foot 5 can be molded in the form of a recess to accept the bayonet-type insert. FIG. 5 is a plan view of the top of the cupped feet 5 showing a preferred interlocking mechanism for attaching the cupped feet 5 to the modular sections 1*a–d* through the holes 7 therein. FIG. 6 is an elevational view of a preferred cupped foot configuration in which the cupped foot 5 is inserted through opening 7, positioned by flange 24 and snaps into place. Other interlocking devices such as screw-type connections can be used as well. The thickness of the walls of the cupped feet 5 is chosen in accordance with the loads which the pallets are anticipated to bear. The cupped feet 5 are preferably tapered toward the bottom to facilitate positioning of the rails thereon by pressure fitting and to enable nesting of the cupped feet when the pallet is dismantled. In addition, it is preferred that cupped feet 5 be open on the bottom to allow drainage of any liquid that might otherwise accumulate during outdoor storage.

FIG. 5 is a top view of a preferred form of cupped foot 5 having a bayonet-type fitting for attachment to the upper deck 1 and a snapfit attachment to the lower deck. The opening on the rails have like configuration. FIG. 6 is an elevation of a cupped foot taken along the section 6—6.

The cupped feet of the pallet assembly are comprised of outer wall 20 at the top of which are four evenly spaced lock tabs 22*a–d*, which lock the cupped feet to complementary openings in the attachment openings in the upper deck. In the outer wall below the lock tabs 22 is a positioning flange 24, which positions the cupped foot against the underside of the upper deck. Through outer wall 20 near the lower end of the cupped foot are located four evenly spaced snap-fit tabs 26*a–d* which lock the cupped foot into complementary openings in the attachment openings of the lower deck. The snap-fit tabs 26 are deflected inward as the lower end of the cupped foot is inserted into the bottom deck attachment holes and then snap into place as the cupped foot is positioned further into the attachment holes, thus locking the cupped foot to the lower deck 3.

Figure 7:
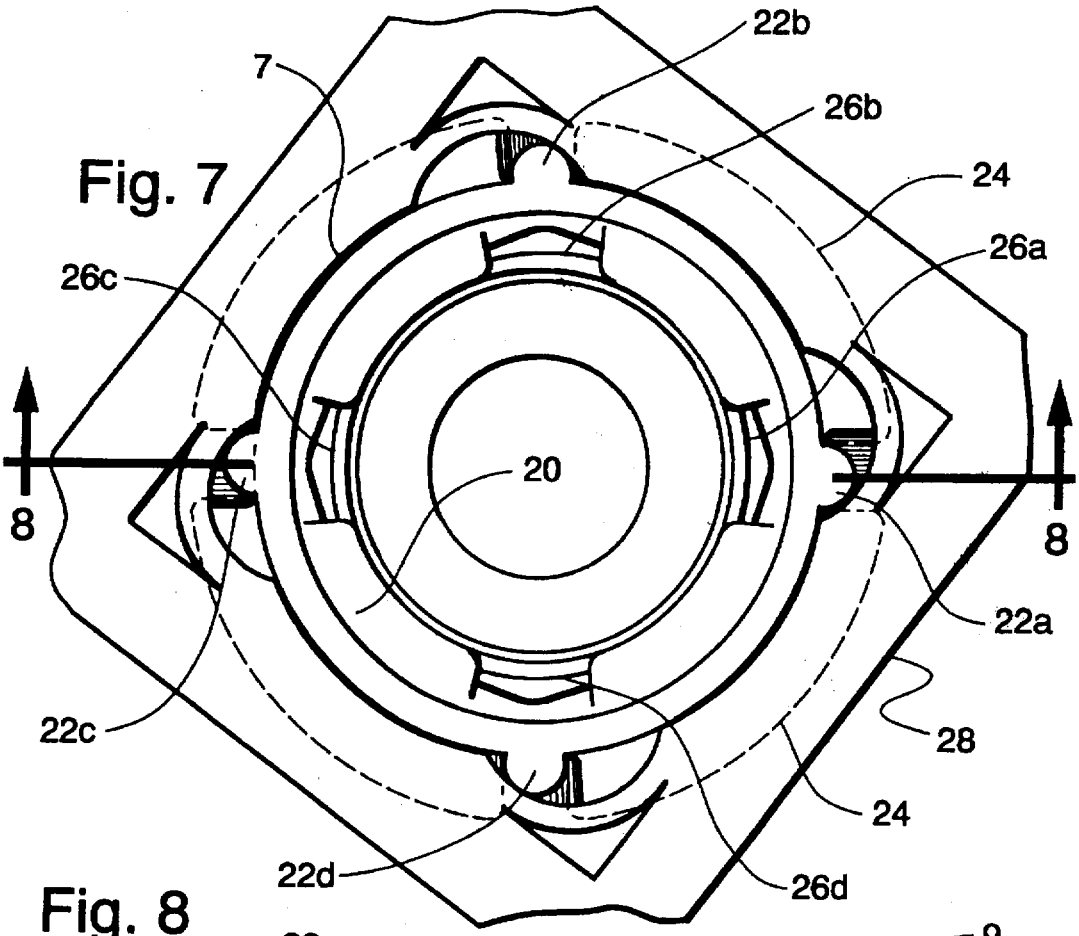
FIG. 7 is a view of a cupped foot which has been attached to the upper deck.
Figure 8:
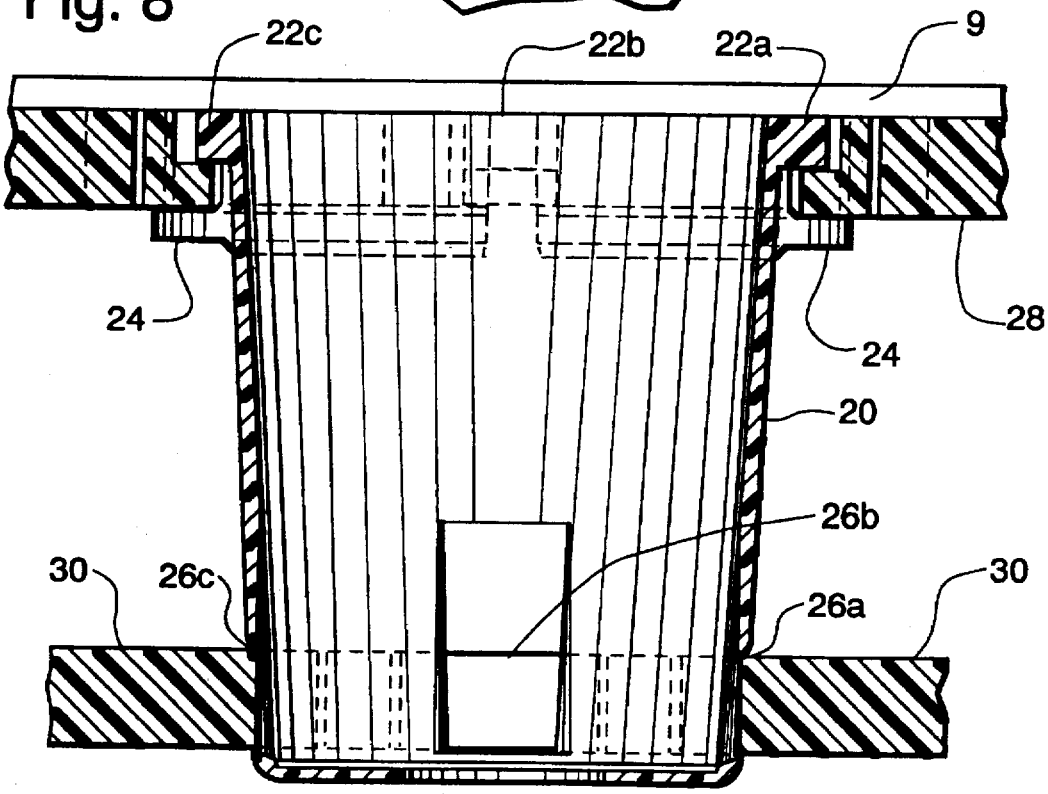
FIG. 8 is a sectional view of the cupped foot of FIG. 7, which has been attached to both the upper and lower decks, taken along the section 8—8 of FIG. 7.

FIG. 7 is a top view of a preferred form of cupped foot as described above. The upper end of the cupped foot has a bayonet-type fitting which has been attached to the upper deck 28 by rotation into complementary fittings in the periphery of the attachment holes in the upper deck 28. FIG. 8 is a sectional view of the cupped foot of FIG. 7 taken along section 8—8 showing attachment of the cupped foot to both the upper deck 28 and lower deck 30. In this sectional view can be seen the positioning flange 24 and snap fitting tabs 26*a–d* which, upon rotation of the cupped foot are compressed and then released into one of a series of evenly spaced grooves on the inside of the attachment holes in the lower deck 3. When the retainer is rotated, it comes into agreement with one of the grooves on the periphery of the attachment holes in the lower deck 30, the retainer springs into the groove and locks the foot in place.

Though the Drawing illustrates the use of circular cupped feet 5, other symmetrical cross sections of four or more sides can be used as well. For example, symmetrical polygons having a multiple of four sides such as squares and octagons can be used.

In the preferred form of the invention as described above, the load deck 1 is comprised of four modular sections 1*a–d*. In standard-sized pallets, it is preferred that at least four sections be employed since they are smaller in size and therefore the cost of the necessary injection molding equipment is much less. Nevertheless, standard-size pallets can be made of three or even two modular sections with appropriate configurational changes. Standard pallets comprising four sections are, however, preferred since all the modular sections can be identical, thereby not requiring a multiplicity of expensive molds.

Though it is preferred for the economic reasons outlined above that the deck be comprised of a plurality of modular sections, it will nevertheless be recognized that it is technologically quite feasible to form the upper deck as a unitary part. That is, the entire deck can be molded as one piece. However, such one piece molded construction of the deck will be, in most instances, more expensive than modular construction.

When either deck is fabricated from modules and the potential loading is anticipated to be excessive, it may be preferred to fuse the modules of either or both decks at various intervals along the lap joints to gain additional rigidity. Continuous fusion of the lap joints will ordinarily not be required. In most instances when the lower deck is modular, it is preferred that the modules be fused together not only to gain greater rigidity, but also to obtain greater stability of the cupped feet connecting the two decks.

While it is preferred that the cupped feet be tapered downward, i.e. Frustoconical in shape, it will be recognized that they can be cylindrical as well and that rotatable snap and groove connections can be used to attach the lower deck to the cupped feet. Another advantage of using tapered feet is that they can be nested to save shipping and storage space when the pallet is disassembled.

Furthermore, the cupped feet can have more than one configuration. For example, the sides of the feet can be tapered in the lower end and straight in the upper end or they can be of square cross section in the upper end and of circular cross section in the lower end. Numerous such geometric combinations can be chosen according to the preferred engineering practice and the economics of each combination vis-a-vis the performance requirements of the pallet.

Symmetry of the array of the cupped feet is preferred in order that complete loading access to the pallet can be obtained on all sides. On the other hand, symmetry of the cupped feet is preferred so that the number of separate molded parts can be minimized. In the configuration discussed above and illustrated in FIG. 1, the entire pallet assembly can be assembled entirely from only three different molded shapes. That is, the upper deck sections are interchangeable as are the cupped feet and the lower deck sections. The simplicity of the assembly facilitates disassembly and reassembly without special tools.

In a still further preferred aspect of the invention, it is preferred that the lower deck be positioned close to or flush with the bottom of the cupped feet in order that flexing of the lower deck be minimized when the pallet is loaded and that the load-bearing area of the pallet be maximized. Ideally, the lower deck is load-bearing during normal use.

It will be recognized by those skilled in the pallet art that the pallets of the invention can be readily designed to obtain special properties and operating convenience. For example, the upper deck surface can be molded to present a roughened surface or coated with adhesive to inhibit sliding movement of loads thereon and the pallet can be molded with appropriate banding slots which eliminate the need for banding clips. In addition, a tongue and groove system can be incorporated to facilitate stretch film wrapping of the loaded pallet. In a still further variation, the perimeter of the deck has an upward extending lip 9 to limit lateral motion of the load. (See FIGS. 1 and 8.)

Materials of Construction:

The pallets of the invention are especially adapted so that they can be made economically from recyclable or recycled polymers. Polymers suitable for use in the invention must be thermoplastic and preferably are water resistant as well. The use of water-resistant polymers is, of course, essential if the pallets are used and/or stored outdoors under conditions by which they are exposed to high humidity and/or precipitation such as rain or snow. In addition, they must be formable by injection molding techniques and thermally stable at injection molding temperatures. Therefore, thermoset polymers and highly cross-linked polymers are not preferred for use in the invention because they are insufficiently thermoplastic to be injection molded.

Polymer classes which meet these criteria include noncrystalline polymers such as polyolefins, polyesters, e.g. poly(ethylene terephthalate), poly(vinyl chloride), ethylene-carbon monoxide copolymers, poly(ether ketones), ethylene vinyl acetate copolymer, and nylon, and crystalline polymers such as polystyrene, acrylics and polycarbonates. However, many acrylic polymers are too brittle for this application. Furthermore, elastomers are generally unsuitable since they are usually cross-linked and therefore less thermoplastic. Preferred polymers for use in making the pallets of the invention are polyolefins such as polyethylene, polypropylene and ethylene-propylene copolymers. High density polyethylene and polypropylene are particularly preferred.

In practice, mixtures of polymers can be used so long as they are compatible or compatibilized and so long as they have similar processing temperatures. The polymers will frequently contain a small amount of secondary materials such as inorganic fillers, reinforcing fibers, plasticizers, UV stabilizers, conditioners, antioxidants and the like.

In order to reduce the weight of the pallet, it is preferred that the pallet components be molded from polymers which have been foamed to reduce the density of the polymeric material.

We claim:

1. A pallet assembly, which may be disassembled to smaller volume for shipping, reassembly and reuse comprising (1) a rigid substantially planar rectangular upper deck having an upper load surface and lower support surface, (2) a plurality of detachable hollow cupped feet having a symmetrical cross section, the open end of which feet depend from and are attached to the upper deck through openings in the deck assembly and the cupped feet are arranged in a centrally positioned symmetrical array of lines and columns, each line and column being comprised of at least three such feet in both the longitudinal and transverse directions of the array, the cupped end of each of the feet being linked both longitudinally and transversely by (3) a rigid substantially planar rectangular lower deck having an upper surface and a lower surface and a plurality of openings through which the cupped feet are connected to the lower deck at or near the cupped end of each of the feet, the open ends of the cupped feet being rotatably attached to the upper deck and the cupped end of the feet being rotatably attached to the lower deck by means of snap-fit connections which are co-rotatable with the upper deck connections of the cupped feet, the complementary components of which connections are molded into the periphery of the feet and the inside surface of the foot attachment openings in the upper and lower decks, the decks and cupped foot members all being formed by injection molding of a molten normally solid thermoplastic polymer.

2. The assembly of claim 1 in which the upper deck is formed from rectangular interlocking modular sections.

3. The assembly of claim 2 in which the feet are affixed to the upper deck by means of a bayonet-type connection, the complementary components of which are molded into the periphery of the feet and the inside surface of the foot attachment openings in the interlocking deck sections.

4. The assembly of claim 2 in which the upper deck sections are interlocked by means of an interlocking lap joint.

5. The assembly of claim 2 in which a plurality of the foot attachment openings are located across joints between two or more modular deck sections by which attachment of the cupped feet to the deck also serves to interlock the modular deck sections.

6. The assembly of claim 2 in which the upper deck modular sections are interlocked by means of interlocking lap joints.

7. The assembly of claim 1 in which the lower deck is comprised of a plurality of rectangular modular sections.

8. The assembly of claim 7 in which the assembled lower deck sections are joined by fusion at the outer edge of the lap joints on the periphery of the assembly.

9. The assembly of claim 7 in which the lower deck modular sections are interlocked by means of an interlocking lap joint.

10. The assembly of claims 6 or 9 in which both assembled deck sections are spot welded at the outer edge of the lap joints on the periphery of the assembly.

11. The assembly of claim 1 in which the cupped feet are attached to the upper deck assembly by means of bayonet-type connections.

12. The assembly of claim 1 in which the lower deck is a single molded piece.

13. The assembly of claim 1 in which the lower surface of the lower deck is load-bearing when the cupped feet are attached thereto.

14. The assembly of claim 13 in which the lower surface of the lower deck is substantially flush with the under surface of the cupped feet.

15. The assembly of claim 1 in which the perimeter of the upper deck has an upward projecting lip to limit the lateral motion of objects supported on the pallet assembly.

16. The assembly of claim 1 in which the load surface is roughened to inhibit sliding motion of objects supported on the pallet assembly.

17. The assembly of claim 1 in which at least the lower portion of the feet is tapered to facilitate nesting of the feet when the pallet is dismantled.

18. The assembly of claim 1 in which the feet are annular in cross section.

19. The assembly of claim 1 in which the surface of the upper deck contains a pattern of perforations to reduce the weight of the assembly.

20. The assembly of claim 1 in which the thermoplastic polymer is a polyolefin selected from polyethylene, polypropylene, ethylenepropylene copolymer and mixtures thereof.

21. The assembly of claim 1 in which the molten polymer contains a small amount of inorganic filler.

22. The assembly of claim 1 in which the molten polymer contains an effective amount of UV stabilizer.

23. The assembly of claim 1 in which the molten polymer has been foamed with an inert gas to reduce the density of the molded polymer.

24. The assembly of claim 1 in which the upper deck is formed from rectangular interlocking sections having a substantially identical configuration.

25. A pallet assembly which may be disassembled to smaller volume for shipping, reassembly and reuse comprising (1) a rigid substantially planar rectangular upper deck having an upper load surface and lower support surface, (2) a plurality of detachable hollow cupped feet having a symmetrical cross section, the open end of which feet depend from and are attached to the upper deck through openings in the deck assembly and the cupped feet are arranged in a centrally positioned symmetrical array of lines and columns, each line and column being comprised of at least three such feet in both the longitudinal and transverse directions of the array, the cupped end of each of the feet being linked both longitudinally and traversely by (3) a rigid substantially planar rectangular lower deck having an upper surface and a lower surface and a plurality of openings through which the cupped feet are connected to the lower deck at or near the cupped end of each of the feet, the open ends of the cupped feet being rotatably attached to the upper deck, and the cupped end of the feet being rotatably attached to the lower deck by means of snap-fit connections which are co-rotatable with the upper deck connections of the cupped feet, the complementary components of which connections are molded into the periphery of the feet and the inside surface of the foot attachment openings in the upper and lower decks, the decks and cupped foot members all being formed by injection molding of a molten normally solid thermoplastic polymer, wherein the upper deck is formed from rectangular interlocking modular sections, and wherein a plurality of the foot attachment openings in the upper deck are located across joints between two or more modular upper deck sections by which attachment of the cupped feet to the upper deck also serves to interlock the modular sections thereof.

* * * * *